US006776139B1

(12) United States Patent
Spoolstra

(10) Patent No.: US 6,776,139 B1
(45) Date of Patent: Aug. 17, 2004

(54) FUEL INJECTOR ASSEMBLY HAVING MULTIPLE CONTROL VALVES WITH A SINGLE ACTUATOR

(75) Inventor: Gregg R. Spoolstra, Byron Center, MI (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/374,009

(22) Filed: Feb. 25, 2003

(51) Int. Cl.[7] ..... F02M 33/04
(52) U.S. Cl. ..... 123/446; 239/88; 123/506
(58) Field of Search ..... 137/595; 251/129.09, 251/129.1; 123/506, 446; 239/88–96

(56) References Cited

U.S. PATENT DOCUMENTS 4,856,713 A 8/1989 Burnett
5,984,210 A * 11/1999 Forck et al. ..... 239/585.1
6,113,014 A 9/2000 Coldren
2002/0071768 A1 6/2002 Spoolstra
2002/0117557 A1 * 8/2002 Potschin et al. ..... 239/88
2002/0145055 A1 * 10/2002 Rodriguez-Amaya et al. ... 239/88
2004/0011887 A1 * 1/2004 Boecking ..... 239/533.2

FOREIGN PATENT DOCUMENTS

EP 0 987 430 A 3/2000
WO WO02/31342 A1 9/2001

* cited by examiner

*Primary Examiner*—Thomas N. Moulis
(74) *Attorney, Agent, or Firm*—Brooks Kushman P.C.

(57) ABSTRACT

A fuel injector for an internal combustion engine has multiple control valves with a single valve actuator. The valves may be packaged in an injector assembly with an economy of space and a simplified assembly procedure during manufacture. The valves are sequenced using calibrated force balance relationships as fuel injection rate shaping is established.

14 Claims, 7 Drawing Sheets

Fig. 1a
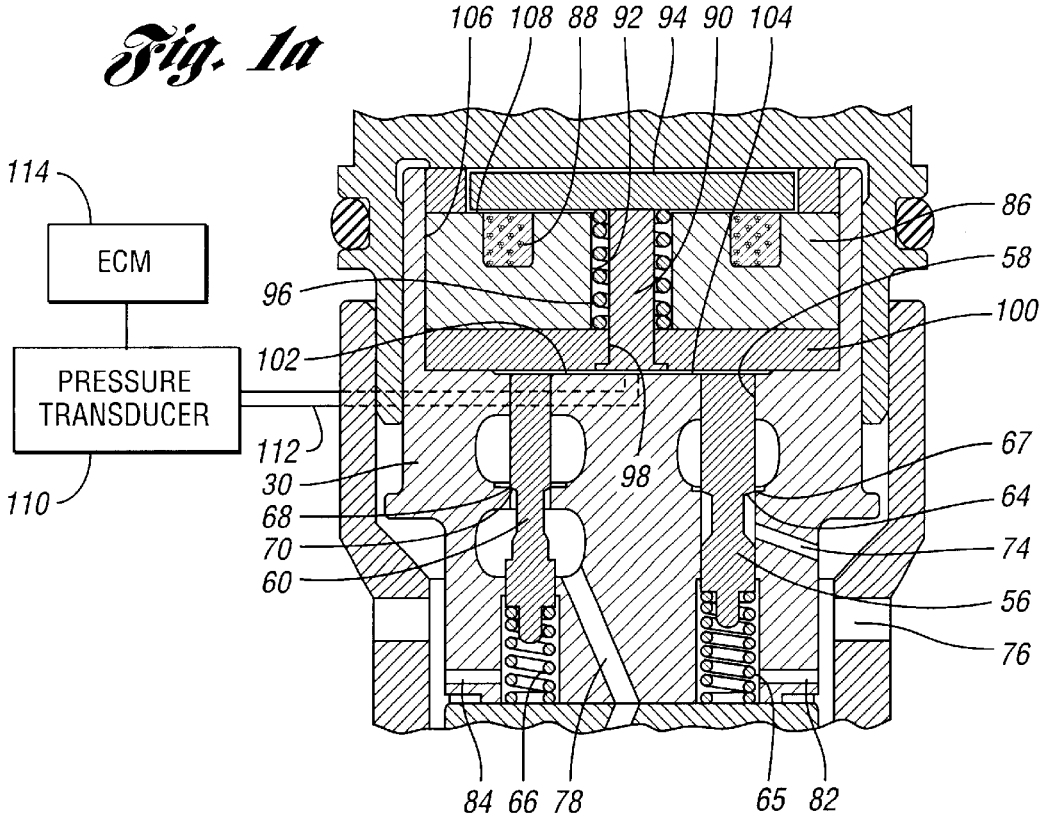
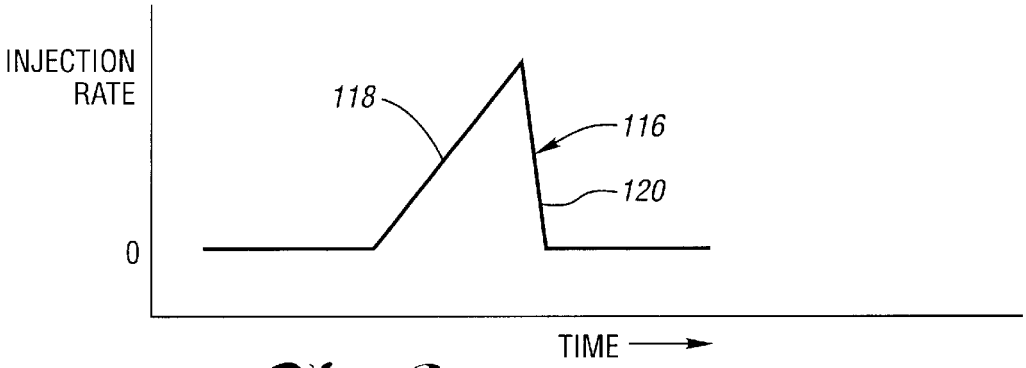
Fig. 2
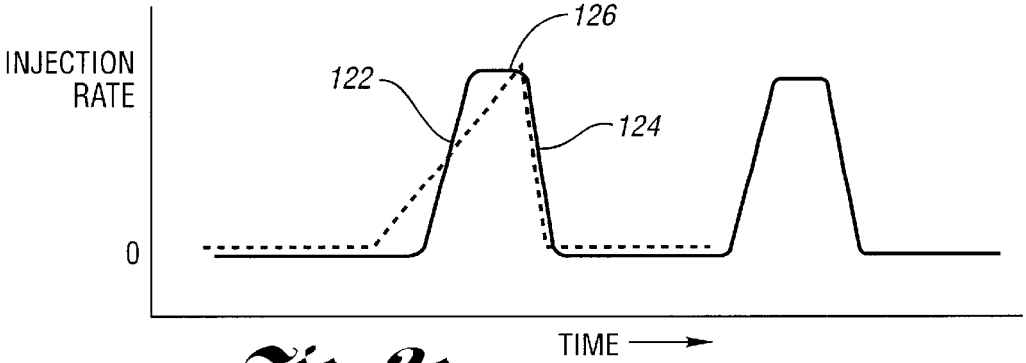
Fig. 2a

FUEL INJECTOR ASSEMBLY HAVING MULTIPLE CONTROL VALVES WITH A SINGLE ACTUATOR

BACKGROUND OF THE INVENTION

1. Field of the Invention

The invention relates to a fuel injector assembly having multiple control valves for controlling engine fuel injection rate and timing.

2. Background Art

Fuel injectors for internal combustion engines, particularly diesel engines, include an injector nozzle body for each power cylinder of the engine. A fuel injector nozzle in the nozzle body receives pressure pulses from an injector pump. In the case of a unit injector assembly, the pump body and the nozzle body are integrated into a common assembly. The pump includes a pumping chamber and a pump plunger in the chamber, the plunger being driven by an engine camshaft-driven cam and cam follower. The cam controls the injection rate and timing of fuel delivery to the nozzle of each engine combustion chamber.

German patent publication WO 02/31342 (A1) discloses a dual control valve arrangement for controlling distribution of fuel to an injector nozzle. The dual valve arrangement of the German publication is calibrated to take into account the necessity to increase vehicle exhaust gas emissions quality. It comprises a control valve system that will achieve optimum combustion efficiency with reduced undesirable exhaust gas emissions throughout each engine cycle. The valves are actuated by electromagnetic actuators, characterized by a minimum reaction time, to control signals distributed to the actuators by an electronic engine control, which monitors engine operating variables. This technique makes possible a rate shaping of a pressure time trace and a time trace for fuel injection rate to achieve minimum engine brake specific fuel consumption.

The valve assembly of the German publication includes a first valve actuated by an electromagnetic actuator between a closed position and an open position, together with an intermediate rate shaping position. The first valve, which is in communication with a pumping chamber, is effective to control the pressure distribution to the nozzle assembly by controlling the rate of fuel bypass flow or fuel spill past the valve to a low-pressure return circuit for a fuel supply pump. One of the valves of one of two embodiments described in the German publication normally is opened by a valve spring, and is moved to the closed position by an electromagnetic actuator comprising a first coil and stator assembly and a separate armature, the armature being connected to the valve. A second valve normally is biased by a valve spring to the open position and is actuated to the closed position by a second, separate solenoid actuator.

The outlet side of the second valve communicates with a nozzle needle valve, which creates a pressure force on the needle valve that complements the force of a needle valve spring. In this way, the shape of an injection rate time plot can be modified depending on the characteristics of the valve. The outlet side of the first valve communicates with a nozzle pressure feed passage to achieve a modified injection pressure that is controlled by its separate solenoid actuator.

SUMMARY OF THE INVENTION

Unlike the multiple valve assembly of the German publication with its separate solenoid actuator assemblies, the present invention comprises a single solenoid actuator that develops electromagnetic forces in proportion to known electromagnetic variables such as the core area, air gap between the stator core and the armature, material properties of the actuator and current level. The valve spring forces can be chosen to achieve the same or different effective forces for each valve, which makes it possible to calibrate and sequence the valve events depending upon current levels. The instant each valve is closed can be detected using a typical pressure transducer in accordance with one embodiment. In accordance with another embodiment, valve closure is detected by measuring a change in the inductance of solenoid actuator coils when armatures for the actuator stop moving.

The invention makes it possible to reduce the number of parts and to package the actuator in a compact injector assembly during manufacture.

The single solenoid driver for the valves reduces the manufacturing cost of the injector and reduces its complexity relative to known injector designs.

The actuator for the injector is under the control of an electronic control module for the engine. If the electronic control module is programmed to require exhaust gas recirculation control, this can be done readily by providing a sharp increase in the rate of pressure buildup for each injection rate for a given injection event rather than a more typical triangular-shape injection pressure buildup rate. By shaping the injection rate profile in this fashion in an injection rate time trace, undesirable particulates in the exhaust gas can be reduced. Furthermore, the shaping of the injection rate time trace will make it possible to improve the brake specific fuel consumption of the engine because it enables the engine to be operated with a more advanced injection timing.

In a typical engine, more exhaust gas recirculation will increase the percentage of the undesirable particulates in the exhaust gases. The particulates can be reduced by increasing mean injection pressure. This is made possible by delaying the beginning of an injection event through manipulation of the two valves.

In a first embodiment of the invention, an actuator armature drives an armature piston into a pressure chamber of reduced volume when the actuator stator is energized. This results in an increase in hydraulic pressure acting on each of the valves, which creates a pressure force that complements the effective spring force on each of the valves. The magnitude of the pressure in the pressure chamber is functionally related in a closed-loop feedback fashion to current in the actuator stator.

The timing of each of the valves can be calibrated using design parameters, such as spring rate, valve diameter, and actuator current.

When the single solenoid of the assembly of the invention is energized with a variable current controlled by an engine control module, the armature piston generates a pressure force that drives the valves. A closed-loop control of the pressure developed by the piston is effected using a pressure transducer. As the pressure generated by the piston increases, the sealing force of the valves increases.

The operation of the multiple valves can be sequenced by independently calibrating the valves. As each valve reaches its limit of travel during sequencing, a momentary pressure change will be detected by the pressure transducer.

In a second embodiment of the invention, the separate control valves are actuated by electromagnetic force rather than by hydraulic force. Each valve has a separate armature and a common solenoid assembly. Each armature is connected to its respective control valve. An inductance bridge circuit may be used to monitor the solenoid inductance to determine the timing of the valve movement using an electrical closed-loop control technique rather than a hydraulic pressure closed-loop control technique as in the first embodiment of the invention.

The stator of the second embodiment can be made with a single stator coil or a dual coil arrangement. In each instance, the solenoid assembly will create a valve actuating force level in proportion to known magnetic variables.

BRIEF DESCRIPTION OF THE DRAWINGS

FIG. 1*a* is an enlarged view of a portion of FIG. 1 showing in more detail the dual valves and an electromagnetic actuator;

FIG. 2 is a schematic representation of an injection rate time plot for a typical fuel injector;

FIG. 2*a* is a plot similar to the plot of FIG. 2, superimposed on the plot of FIG. 2, with injection rate pulses shaped with a steep pressure buildup followed by a steep pressure decrease at the end of an injection event;

DETAILED DESCRIPTION OF THE PREFERRED EMBODIMENT(S)

Although the disclosed injector is a unit injector, the invention may be used also in a unit pump assembly.

Figure 1:
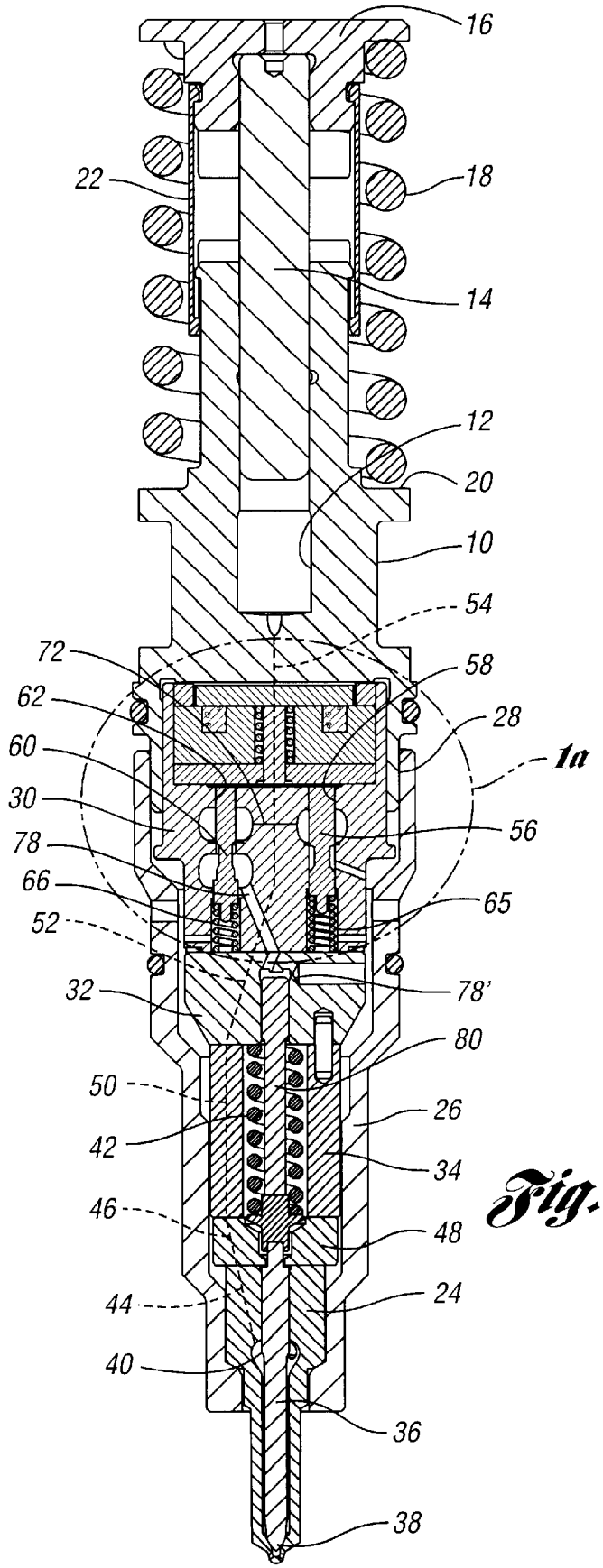
FIG. 1 is a cross-sectional assembly view of a unit injector assembly capable of embodying the invention.

The injector of FIGS. 1 and 1*a* includes a pump body 10 with a high pressure pumping chamber 12, which receives a plunger 14. A cam follower 16, connected to the upper end of the plunger 14, engages an engine camshaft operated mechanism (not shown). The plunger reciprocates in the chamber 12, and a cam follower spring 18, seated on the pump body at 20, urges the cam follower in an upward direction. Cam follower guide 22 reciprocates with the plunger.

A nozzle body 24 is received in a nozzle nut 26. The nozzle nut is threaded at 28 to the pump body 10. Valve body 30 is assembled in the nozzle nut 26 in axially stacked relationship with respect to a separator plate 32 and a spring cage 34. A nozzle valve element 36 is mounted within the nozzle body 24. It includes a nozzle tip portion 38, which controls injection of pressurized fluid through orifices formed in nozzle body 24.

The nozzle valve element 36, sometimes called a needle valve, includes a differential area 40, which, when pressurized, is subjected to an upward force on the needle valve element. This opposes the oppositely directed needle valve spring force of spring 42 in spring cage 34. The pumping chamber 12 communicates with the needle valve through internal passages 44 in the nozzle body 24, passage 46 in a spacer 48, passage 50 in the spring cage 34, passage 52 in the separator plate 32, and passage 54 in the valve body 30. A first valve 56 is situated in valve opening 58, and a second valve 60 is situated in valve opening 62. Each valve is a poppet-type valve and each is spring-loaded in an upward direction by valve springs 65 and 66, respectively. Valve 56 has a valve land 64, seen best in FIG. 1*a*, which registers with valve seat 67 when the valve is closed. Valve 60 has a valve land 68, which registers with valve seat 70 when the valve is closed. Pressure is distributed to each valve from the high pressure pumping chamber 12 through internal passage 54 and cross-passage 72, seen in FIG. 1.

When the valve 56 opens, pressure is distributed from the high pressure passage 72 of FIG. 1 to spill passage 74 of FIG. 1*a*, which in turn communicates with low-pressure flow return port 76. When valve 60 is opened, pressure in passage 72 is distributed to passage 78, seen in FIG. 1*a*, which communicates with the upper surface of needle valve piston 80, seen in FIG. 1. Passage 78 communicates with port 76 through a calibrated flow restricting orifice, seen at 78' in FIG. 1. Orifice 78' is calibrated to effect controlled rates of pressure increase and pressure decrease at the upper surface of needle valve piston 80 when valve 60 opens and closes. Spring chambers for springs 65 and 66 communicate with equalizer pressure passages 82 and 84, respectively, which in turn communicate with the low-pressure return port at 76. The actuator solenoid for valve 56 and the actuator solenoid for valve 60 comprise a single assembly with stator coil windings 88. Armature piston 90 is located in central piston opening 92. Piston 90 is carried by a single armature 94, which is biased in an upward direction by a stator spring 96.

Piston 90 is movably positioned in opening 98 in a stator spacer plate 100. A pressure chamber 102 is situated between the spacer plate 100 and the surface 104 at the base of stator opening 106 formed in the valve body 30. The armature 94 has an air gap between the upper surface of the stator 86, as shown at 108, and the lower surface of the armature 94. The spring 96 opens the air gap, thereby driving the piston 90 in an upward direction. In a typical embodiment, the air gap may be about 0.004 inches when the solenoid is energized and about 0.010 inches when the solenoid is de-energized.

When the stator windings are energized, the air gap is closed against the opposing force of the valve spring 96, thereby driving the lower end of the piston 90 into the chamber 102. This creates a hydraulic valve actuating force on the upper surface of each of the valves 56 and 60. That hydraulic force opposes the force of valve springs 65 and 66 and tends to close each valve. The spring force, the valve diameters and the geometry of the valve lands for each valve can be separately calibrated so that the valves can be opened and closed sequentially or in tandem in a rate shaping technique that will be demonstrated with reference to FIG. 4.

Figure 3:
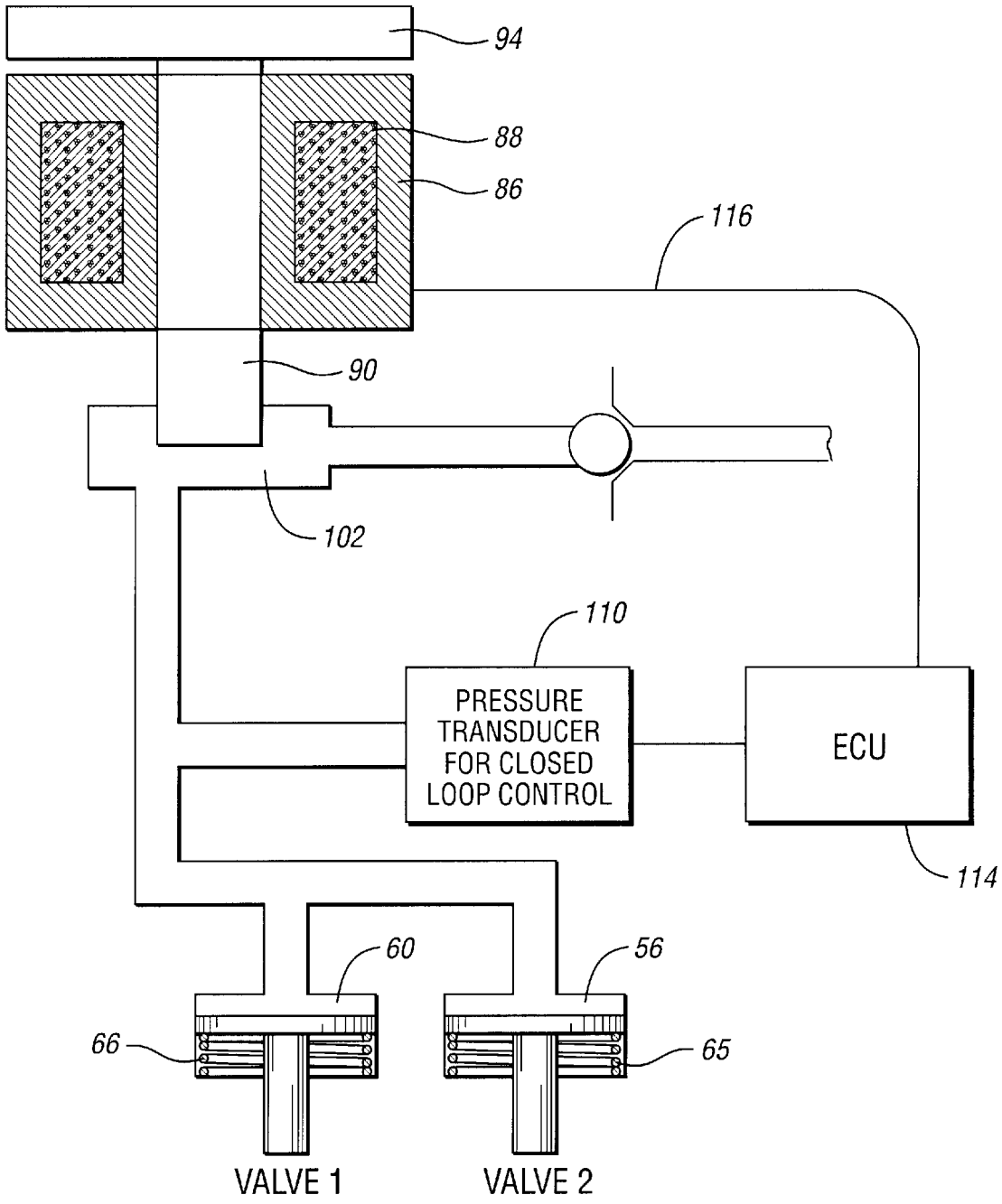
FIG. 3 is a schematic diagram of the principal elements of the injector assembly of FIGS. 1 and 1*a;*

A pressure transducer 110, seen in FIG. 3, communicates with the high pressure chamber 102 through internal passage 112, seen in FIG. 1*a*. The pressure signal developed by the transducer 110 is distributed to the electronic control unit (ECU) for the engine, as shown at 114.

FIG. 2 shows a typical injection rate time plot with a generally triangular profile, as shown at 116. The injection rate buildup from a zero value to its peak value has a rather low slope, as seen at rate trace line 118 in FIG. 2. When the injection pulse is terminated, typically the trace profile will decrease, as shown by the line 120, with high negative slope.

FIG. 2*a* is a plot, superimposed on profile 116 of FIG. 2, which shows a modified injection rate trace profile for injection pluses. By calibrating the valves 56 and 60, it is possible to increase the slope of an injection rate profile, as shown at 122. By appropriately calibrating the valves, the rate of decrease of the injection rate indicated at 124 also can be controlled after the peak injection pulse rate, shown at 126, is achieved.

FIG. 3 is a schematic diagram of the embodiment of FIGS. 1 and 1*a*. The pressure transducer 110, seen in FIG. 3, distributes its signal to the electronic control module 114, which in turn transfers an actuating current to the windings 88, as shown at 116.

Figure 4:
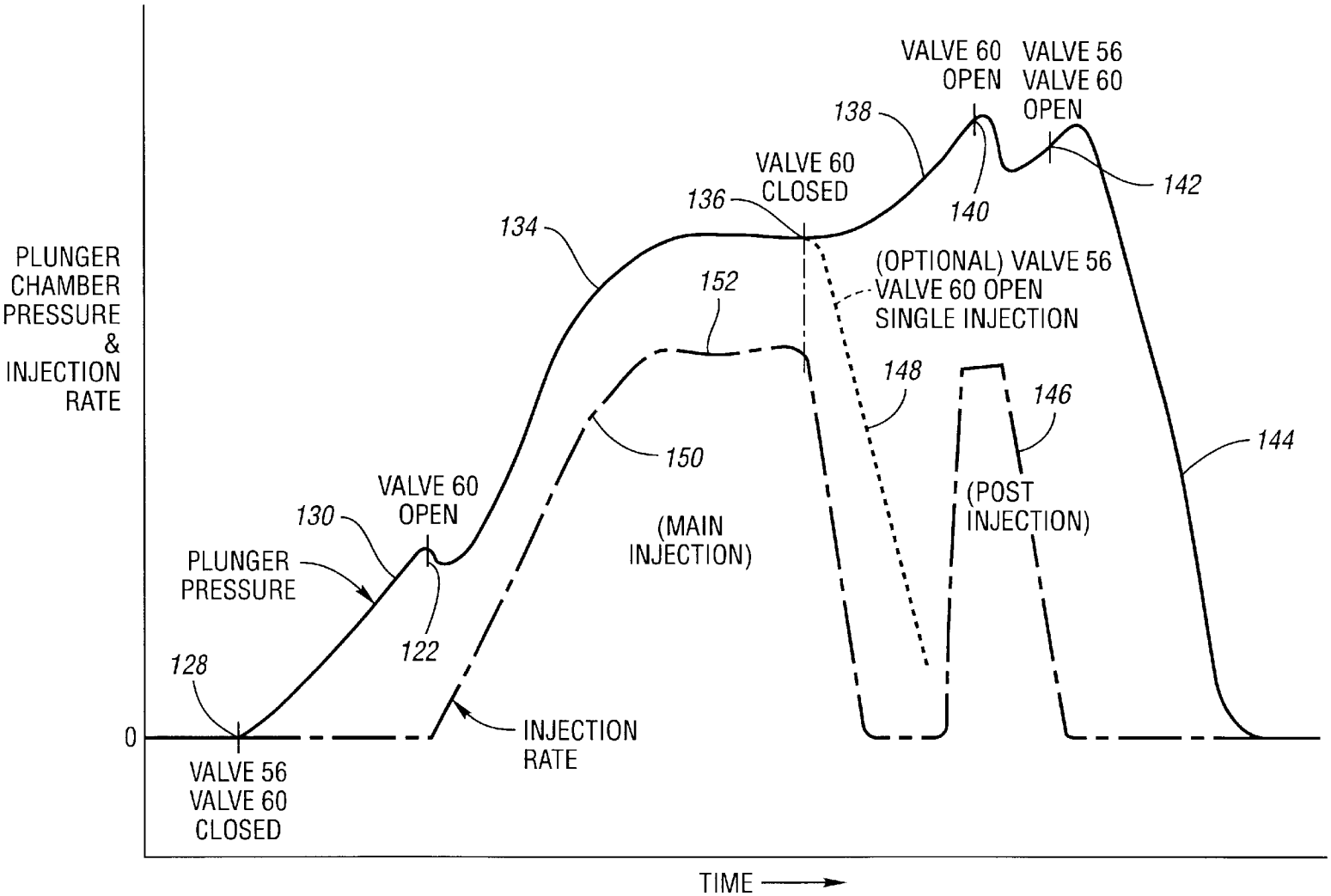
FIG. 4 is a pressure time plot and an injection rate time plot, superimposed, to demonstrate the sequence of the control valve functions for each of the control valves in creating a desired shape of the pressure pulses and the injection rate pulses during an injection event.

FIG. 4 is a plot of traces that show both plunger chamber pressure and injection rate as a function of time. At the beginning of an injection event, when the injection pressure is zero, both valves 56 and 60 are closed, as seen at 128. The pressure builds up in a typical fashion as shown at 130. At 122, valve 60 is opened, thereby causing a momentary drop in pressure due to hydraulic dynamics. This allows the pressure in passage 78, which acts on the upper surface of needle valve piston 80, to drop, thereby allowing needle valve piston 80 and needle valve element 36 to lift. This allows the injection event to start as fuel is injected through nozzle orifices opened by nozzle tip portion 38. That is followed by an increase in injection pressure at a lower rate, as shown at 134. As the injection event continues, valve 60 will close at point 136 and the plunger pressure profile then will increase again at a higher rate, as shown at 138, until a peak value is obtained at point 140. When valve 60 closes, high pressure fuel enters passage 78, forcing down needle valve piston 80 and needle valve element 36. This closes the fuel flow path through the orifices at nozzle tip portion 38 and ends the injection event. Valve 60 is opened again at point 140 to allow pressure in passage 78 to drop and needle valve piston 80 and needle valve element 36 to open. This begins a post-injection event. That is followed by opening of valves 60 and 56 at point 142, which ends the post-injection event. The injection pressure then will decline at a rapid rate, as shown at 144.

The opening of valve 60 at point 140 will produce a so-called post-injection rate pulse, as shown at 146, if that is desired. If only a single injection cycle is desired, however, valve 56 and valve 60 both are open at point 136, which results in a decline in the injection pressure, as illustrated by the dotted line 148. A post-injection pulse would be used if it is necessary to reduce undesirable engine exhaust gas emissions.

An injection rate time trace that corresponds to the plunger pressure time trace of FIG. 4 is indicated at 150. In general, the injection rate increases as the plunger pressure increases until a peak injection rate is reached at 152. The post-injection trace 146 is part of the injection rate trace.

Figure 5:
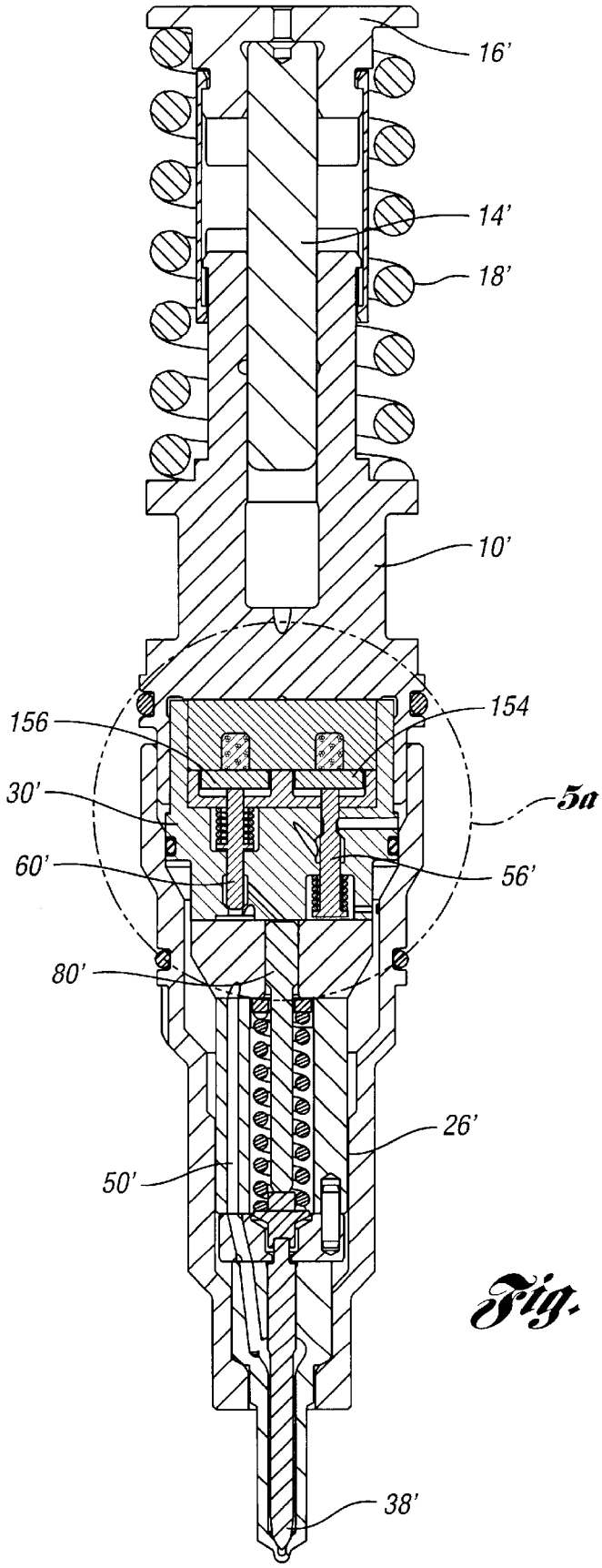
FIG. 5 is a cross-sectional view of an injector, similar to the view of FIG. 1, wherein the actuator develops electromagnetic forces, rather than hydraulic forces, acting on the control valves.
Figure 5A:
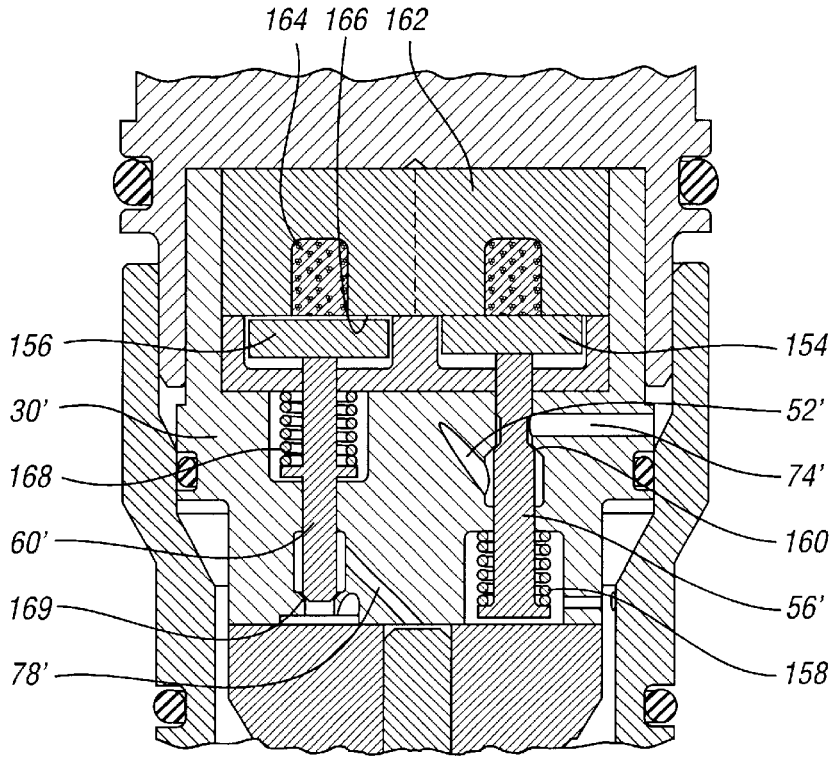
FIG. 5*a* is an enlarged cross-sectional view of a portion of the injector assembly of FIG. 5, including a single coil in the stator.

In the embodiment of FIGS. 5 and 5*a*, the single actuator relies upon electromagnetic forces rather than hydraulic forces to control the valves 56' and 60', which correspond to valves 56 and 60 of the FIG. 1 embodiment. The valves 56' and 60' are connected directly to armatures 154 and 156, respectively. Valve 56' is urged in the downward direction by valve spring 158, seen in FIG. 5*a*, toward the open position. Valve land 160 is closed against its valve seat in valve body 30' by an electromagnetic force acting on the armature 154. The actuator of FIG. 5*a* includes a stator 162, which has a coil winding 164, and an air gap 166 at the interface of the stator 162 and the armature. The air gap is closed when the windings 164 are energized.

In the case of valve 60', a valve spring 168 urges the valve to its closed position, as shown at 169.

In FIG. 5*a*, prime notations are used with numerals that correspond to the numerals used in FIGS. 1 and 1*a* to designate corresponding elements. Similarly, in FIG. 6, prime or double prime notations are used with the numerals to indicate elements that have corresponding elements in the embodiment of FIG. 5*a*.

Figure 6:
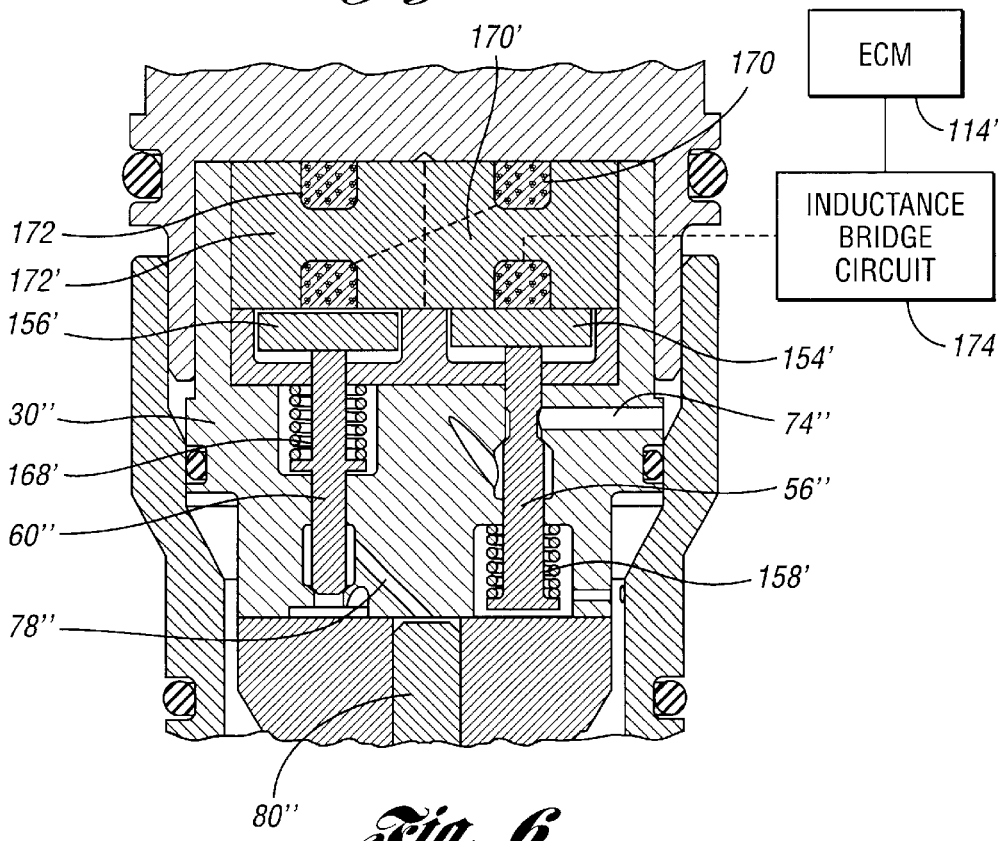
FIG. 6 is a view similar to FIG. 5*a*, but it includes a stator assembly having two coils.

In the case of the embodiment of FIG. 6, two coils 170 and 172 are used and are connected in series in a common circuit. These create separate magnetic flux fields in "C" shaped cores 170' and 172' for coils 170 and 172, respectively, which act upon the respective armatures 154' and 156'. These flux fields correspond to the single flux field created by the winding 164 of the FIG. 5*a* embodiment.

In each of the embodiments of FIGS. 5*a* and 6, an inductance sensor, shown schematically at 174, is used to monitor the valve position. The function of this sensor 174 essentially is the same as the function of the pressure transducer 110 in the embodiment of FIGS. 1 and 1*a*. The output of the sensor 174 is distributed to the electronic engine control module 114'.

Figure 5B:
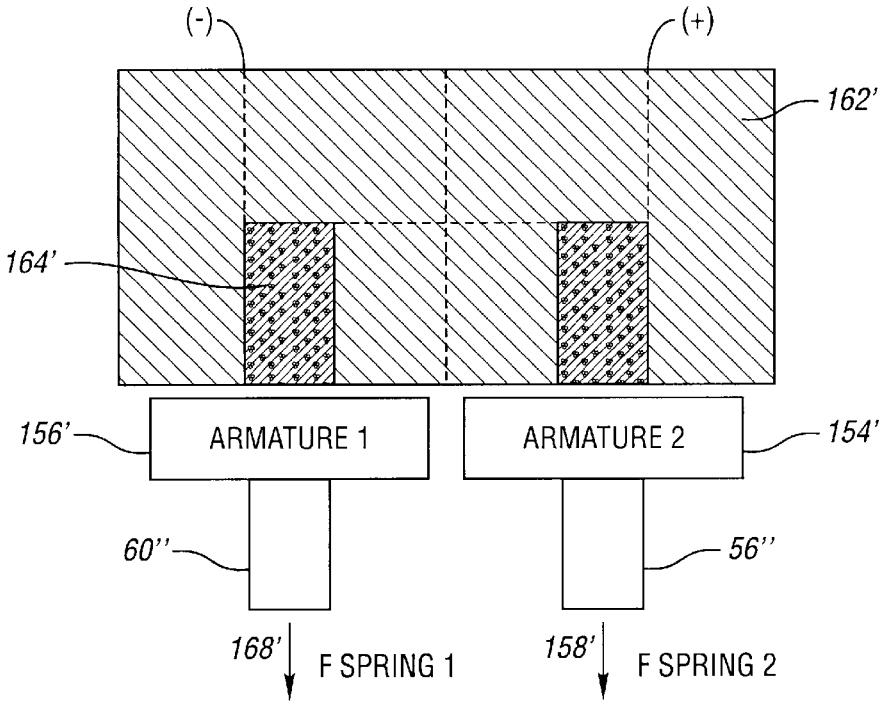
FIG. 5*b* is a schematic diagram of the single coil design shown in FIG. 5*a;*

FIG. 5*b* is a schematic diagram of the design of FIG. 5*a*. Reference numerals used in FIG. 5*b* correspond to reference numerals used in FIG. 5*a* to designate corresponding elements, but prime or double prime notations are added.

Figure 6A:
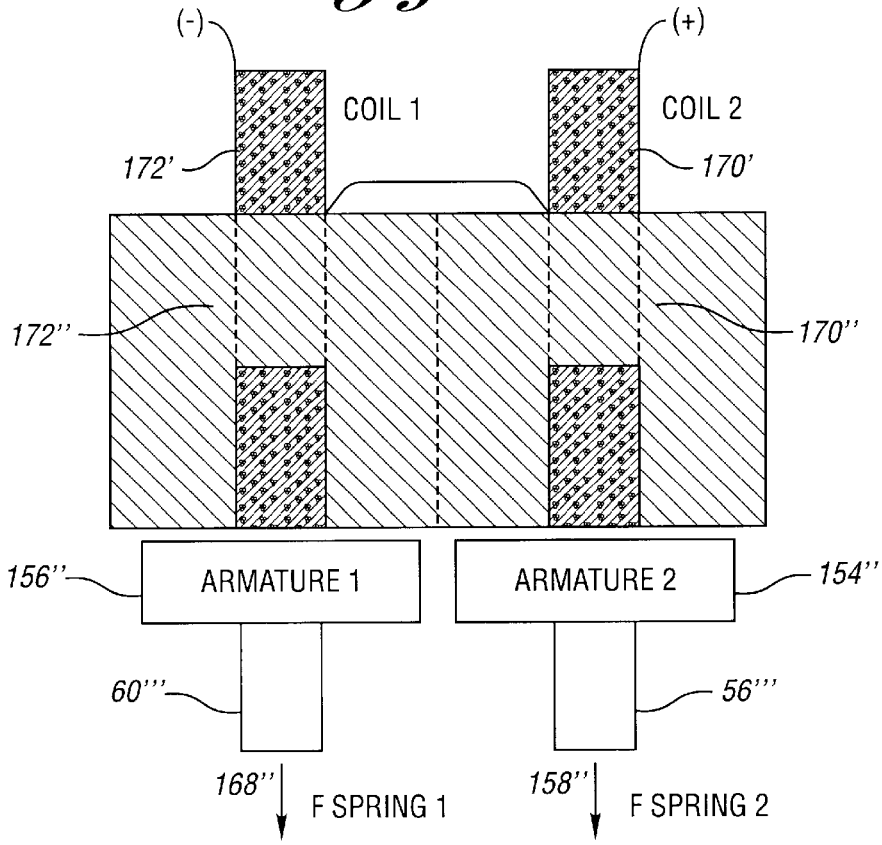
FIG. 6*a* is a schematic diagram of the dual coil design of FIG. 6.

FIG. 6*a* is a schematic diagram of the design of FIG. 6. As in the case of FIG. 5*b*, reference numerals used in FIG. 6*a* correspond to reference numerals used in FIG. 6, but prime, double prime or triple prime notations are added.

The single coil design of FIGS. 5*a* and 5*b* and the dual coil design of FIGS. 6 and 6*a* have two armatures, rather than one. This achieves force levels for each control valve in proportion to known electromagnetic variables, such as core area, air gap, material properties and current level. In both designs only a single current source or drive circuit is required to actuate both valves. Opposing spring forces may be different, or the same, for each armature, resulting in the ability to sequence valve events, as explained with reference to FIG. 4, as current levels change. With a single current source or drive circuit, the closing of each valve can be detected using closed-loop inductance feedback, as previously explained.

Although specific embodiments of the invention have been described, it will be apparent to persons skilled in the art that modifications may be made without departing from the scope of the invention. All such modifications and equivalents thereof are intended to be covered by the following claims.

What is claimed is:

1. A fuel injector for an internal combustion engine having at least one air-fuel combustion chamber, the fuel injector including a fuel injection nozzle assembly for injecting fuel into the combustion chamber during an injection event for each engine cycle, an engine-driven injector pump for developing injector pressure for distribution to the nozzle assembly and a control valve assembly for controlling fuel delivery to the nozzle assembly, the control valve assembly comprising:

a pair of control valves in a nozzle pressure feed passage, the feed passage extending from a high pressure pumping chamber of the injector pump to the nozzle assembly;

a low pressure fuel spill passage communicating with one control valve of the pair, the one control valve opening communication between the nozzle feed passage and the low pressure spill passage when it is moved toward an open position and closing communication between the nozzle feed passage and closing communication between the nozzle feed passage and the low pressure spill passage when it is moved toward a closed position whereby pressure pulses with controlled timing are developed during an injection event;

the nozzle assembly including injection orifices and a needle valve element for controlling opening and closing of the injection orifices to establish controlled fuel injection rate and pressure pulse timing;

a second control valve of the pair opening and closing communication between the nozzle feed passage and the needle valve element as the second control valve is actuated between an open position and a closed position whereby the timing of the pressure pulses and the shape of a pressure time trace for the one control valve are modified by the second control valve; and a single solenoid actuator for the one control valve and the second control valve, the solenoid actuator comprising a single stator with solenoid windings and at least one armature adjacent the windings whereby the armature is subjected to electromagnetic forces when the windings are energized to develop a magnetic flux field;

the armature developing control valve actuating forces on the control valves when the windings are energized whereby pressure pulse timing and fuel injection rate are controlled.

2. The fuel injector set forth in claim 1 wherein the needle valve element includes a first pressure area subjected to pressure in the nozzle feed passage tending to open the injection orifices and a second pressure area subjected to pressure developed by the second control valve whereby the shape of an injection rate time trace for the injector is controlled.

3. The fuel injector set forth in claim 2 wherein the injection rate time trace is characterized by a decreased rate of injection pressure buildup during an injection event at an initial phase of the injection event followed by a greater injection pressure buildup rate during a subsequent phase of the injection event.

4. The fuel injector set forth in claim 1 wherein the single solenoid actuator comprises a single armature adjacent the stator windings with an air gap therebetween, an armature piston connected to the armature adjacent the stator; and a control valve pressure chamber in communication with the armature piston whereby movement of the armature develops a control valve chamber pressure that acts on the one control valve and the second control valve.

5. The fuel injector set forth in claim 1 wherein each of the pair of control valves includes a separate control valve spring that opposes pressure actuating forces on the control valves, the control valve springs and dimensions of the control valves being calibrated to achieve desired injection rate and timing for the pressure pulses.

6. The fuel injector set forth in claim 2 wherein the single solenoid actuator comprises a single armature adjacent the stator windings with an air gap therebetween, an armature piston connected to the armature adjacent the stator; and a control valve pressure chamber in communication with the armature piston whereby movement of the armature develops a control valve chamber pressure that acts on the one control valve and the second control valve.

7. The fuel injector set forth in claim 2 wherein each of the pair of control valves includes a separate control valve spring that opposes pressure actuating forces on the control valves, the control valve springs and dimensions of the control valves being calibrated to achieve desired injection rate and timing for the pressure pulses.

8. A fuel injector for an internal combustion engine having at least one air-fuel combustion chamber, the fuel injector including a fuel injector nozzle assembly for injecting fuel into the combustion chamber during an injection event for each engine cycle, an engine-driven injector pump for developing injector pressure for distribution to the nozzle assembly and a control valve assembly for controlling fuel delivery to the nozzle assembly, the control valve assembly comprising:

at least two control valves in a nozzle pressure feed passage, the feed passage extending from a high pressure pumping chamber of the injector pump to the nozzle assembly;

a low pressure fuel spill passage communicating with a first control valve, a first control valve opening communication between the nozzle feed passage and the low pressure spill passage when it is moved toward an open position and closing communication between the nozzle feed passage and the low pressure spill passage when it is moved toward a closed position whereby pressure pulses with controlled timing are developed during an injection event;

the nozzle assembly including injection orifices and a needle valve element for controlling opening and closing of the injection orifices to establish controlled fuel injection rate and pressure pulse timing;

a second control valve opening and closing communication between the nozzle feed passage and the needle valve element as the second control valve is actuated between an open position and a closed position whereby the timing of the pressure pulses and the shape of a pressure time trace for the first control valve are modified by the second control valve; and a single solenoid actuator for the first control valve and the second control valve, the solenoid actuator comprising a single stator with solenoid windings and a separate armature connected to each control valve, the armatures being subjected to electromagnetic forces when the windings are energized to develop a magnetic flux field;

the armatures developing control valve actuating forces on the control valves when the windings are energized whereby pressure pulse timing and fuel injection rate are controlled.

9. The fuel injector set forth in claim 8 wherein the nozzle needle valve element includes a first pressure area subjected to pressure in the nozzle feed passage tending to open the injection orifices and a second pressure area subjected to pressure developed by the second control valve whereby the shape of an injection rate time trace for the injector is controlled.

10. The fuel injector set forth in claim 9 wherein the injection rate time trace is characterized by a decreased rate of injection pressure buildup during an injection event at an initial phase of the injection event followed by a greater injection pressure buildup rate during a subsequent phase of the injection event.

11. The fuel injector set forth in claim 4 including a pressure transducer for developing an electrical signal that is functionally related to pressure in the control valve pressure chamber, the engine including an electronic engine control;

the pressure transducer being in communication with the electronic engine control whereby an engine response to multiple engine operating variables includes a closed-loop response to pressure transducer signals during an injection event.

12. The fuel injector set forth in claim 8 including an inductance sensor in communication with the solenoid windings to detect armature movement, the engine including an electronic engine control;

the inductance sensor being in communication with the electronic engine control whereby an engine response to multiple engine operating variables includes a closed-loop response to changes in inductance during an injection event.

13. The fuel injector set forth in claim 8 wherein the solenoid actuator comprises a stator core and the solenoid windings comprise a single coil within the stator core, the armatures being separated from a stator core face by a controlled air-gap, the magnitude of the air-gap being variable during an injection event as the strength of a magnetic flux field developed by the coil varies as a function of solenoid current.

14. The fuel injector set forth in claim 8 wherein the solenoid actuator comprises a stator core and the stator windings comprise two coils connected in series within the stator core, the armatures being separated from a stator core face by a controlled air-gap, the magnitude of the air-gap being variable during an injection event as the strength of a magnetic flux field developed by the coil varies as a function of solenoid current.

* * * * *